US006753823B2

(12) United States Patent
Matz et al.

(10) Patent No.: US 6,753,823 B2
(45) Date of Patent: Jun. 22, 2004

(54) ANTENNA WITH INTEGRAL ALIGNMENT DEVICES

(75) Inventors: William R. Matz, Atlanta, GA (US); Timothy H. Weaver, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 09/750,975

(22) Filed: Dec. 29, 2000

(65) Prior Publication Data

US 2002/0084941 A1 Jul. 4, 2002

(51) Int. Cl.[7] ..... H01Q 3/00
(52) U.S. Cl. ..... 343/760; 343/878; 343/894
(58) Field of Search ..... 343/760, 878, 343/880, 881, 882, 894; 248/544; 33/333, 352; 342/359

(56) References Cited

U.S. PATENT DOCUMENTS

| | | | |
|---|---|---|---|
| 110,434 A | | 12/1870 | Clarke |
| 780,947 A | | 1/1905 | Grabe |
| 1,303,249 A | | 5/1919 | Brown |
| 1,522,751 A | | 1/1925 | Sechler |
| 1,935,246 A | | 11/1933 | Kirsch |
| 2,463,176 A | | 3/1949 | Hogrefe |
| 2,575,917 A | | 11/1951 | Johnson |
| 2,611,566 A | | 9/1952 | Landis |
| 2,614,861 A | | 10/1952 | Van Horn |
| 2,667,317 A | | 1/1954 | Trebules |
| 2,754,156 A | | 7/1956 | Elderkin |
| 3,910,561 A | | 10/1975 | Formells |
| 3,941,340 A | | 3/1976 | Rankins |
| 4,095,230 A | | 6/1978 | Salmond et al. |
| 4,126,865 A | | 11/1978 | Longhurst et al. |
| 4,237,465 A | * | 12/1980 | Shibano et al. ..... 343/894 |
| 4,258,568 A | | 3/1981 | Boetes et al. |
| 4,495,706 A | | 1/1985 | Kaminski |
| 4,626,864 A | | 12/1986 | Micklethwaite |

(List continued on next page.)

OTHER PUBLICATIONS

Photograph of antenna and mounting bracket, manufactured by Channel Master Company and believed to have been publicly available more than one year prior to the filing date of the subject application.
U.S. patent application Ser. No. 09/467,574, McDonald, filed on Dec. 1999.
U.S. patent application Ser. No. 10/008,424, Saunders et al., filed on Nov. 2001.
U.S. patent application Ser. No. 10/014,284, Matz et al., filed on Dec. 2001.
U.S. patent application Ser. No. 10/014,285, Matz et al., filed on Dec. 2001.
U.S. patent application Ser. No. 10/302,023, Matz et al., filed on Nov. 2002.
U.S. patent application Ser. No. 10/350,655, Watson, filed on Jan. 2003.
U.S. patent application Ser. No. 10/364,099, Matz et al., filed on Feb. 2003.

*Primary Examiner*—Tho Phan
(74) *Attorney, Agent, or Firm*—Kirkpatrick & Lockhart LLP

(57) ABSTRACT

An antenna that has an alignment device for aligning an antenna with a satellite integrally attached thereto. In one embodiment, the device includes a compass for orienting the antenna at a desired azimuth setting. In another embodiment, the device includes a compass and a level for orienting the antenna at a desired elevation. Another embodiment includes a compass and first and second digital levels that cooperate to emit a skew signal that is indicative of the skew orientation of the antenna when the device is affixed to the antenna.

39 Claims, 12 Drawing Sheets

U.S. PATENT DOCUMENTS 4,691,207 A 9/1987 Timineri
4,726,259 A 2/1988 Idler
4,833,932 A 5/1989 Rogers
4,990,924 A 2/1991 McMullen et al.
5,065,969 A 11/1991 McLean
5,088,672 A 2/1992 Neuendorf et al.
5,138,651 A 8/1992 Sudo
5,276,972 A 1/1994 Staney
5,351,060 A 9/1994 Bayne
5,376,941 A 12/1994 Fukazawa et al.
5,463,403 A 10/1995 Walker et al.
5,469,182 A 11/1995 Chaffee
5,473,335 A 12/1995 Tines
5,561,433 A 10/1996 Chaney et al.
5,589,837 A 12/1996 Soleimani et al.
5,621,418 A 4/1997 Maloney
5,646,638 A 7/1997 Winegard et al.
5,647,134 A 7/1997 Chou
5,657,031 A * 8/1997 Anderson et al. ..... 343/757
5,664,752 A 9/1997 Matthiessen et al.
5,734,356 A * 3/1998 Chang ..... 343/882
5,760,739 A 6/1998 Pauli
5,764,186 A 6/1998 Yoo
5,829,121 A 11/1998 Shoemaker et al.
5,870,059 A 2/1999 Reynolds
5,884,199 A 3/1999 Maki
5,894,674 A 4/1999 Feldman
5,903,237 A 5/1999 Crosby et al.
5,915,020 A 6/1999 Tilford et al.
5,920,291 A 7/1999 Bosley
5,923,288 A 7/1999 Pedlow, Jr.
5,933,123 A 8/1999 Kaul
5,940,028 A 8/1999 Iwamura
5,945,945 A 8/1999 Wagner et al.
D413,603 S 9/1999 Inoue
5,977,922 A 11/1999 Hemmingsen, II
5,992,809 A 11/1999 Sweere et al.
5,999,139 A * 12/1999 Benjamin et al. ..... 343/765
6,008,769 A 12/1999 Palmiter et al.
6,023,247 A 2/2000 Rodeffer
6,031,508 A 2/2000 Ishizuka et al.
6,037,913 A 3/2000 Johnson
6,188,372 B1 * 2/2001 Jackson et al. ..... 343/882
6,208,314 B1 3/2001 Bourquin
6,216,266 B1 4/2001 Eastman et al.
6,229,480 B1 5/2001 Shintani
6,262,687 B1 7/2001 Bai et al.
6,285,338 B1 9/2001 Bai et al.
6,331,839 B1 12/2001 Grenell
D453,151 S 1/2002 Weaver
6,337,658 B1 1/2002 Tong et al.
D453,330 S 2/2002 Weaver
6,480,161 B2 11/2002 Watson
6,484,987 B2 11/2002 Weaver
6,486,851 B2 11/2002 Weaver
6,507,325 B2 1/2003 Matz et al.
6,559,806 B1 5/2003 Watson
6,580,391 B1 6/2003 Kepley et al.
6,683,581 B2 1/2004 Matz et al.
2002/0083573 A1 7/2002 Matz et al.
2002/0083574 A1 7/2002 Matz et al.
2002/0084946 A1 7/2002 Matz et al.

* cited by examiner

ANTENNA WITH INTEGRAL ALIGNMENT DEVICES

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to antennas and, more particularly antennas with devices for aligning an antenna with a satellite.

2. Description of the Invention Background

The advent of the television can be traced as far back to the end of the nineteenth century and beginning of the twentieth century. However, it wasn't until 1923 and 1924, when Vladimir Kosma Zworykin invented the iconoscope, a device that permitted pictures to be electronically broken down into hundreds of thousands of components for transmission, and the kinescope, a television signal receiver, did the concept of television become a reality. Zworykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted via terrestrial radio systems and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be required.

Modem digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or are mounted to a tree or mast located in the subscriber's yard. A typical antenna constructed to received satellite signals comprises a dish-shaped reflector that has a support arm protruding outward from the front surface of the reflector. The support arm supports a low noise block amplifier with an integrated feed "LNBF". The reflector collects and focuses the satellite signal onto the LNBF which is connected, via cable, to the subscriber's television.

To obtain an optimum signal, the antenna must be installed such that the centerline axis of the reflector, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed. Also, as the satellite orbits the earth, it may be so oriented such that it sends a signal that is somewhat skewed. To obtain an optimum signal, the antenna must also be adjustable to compensate for a skewed satellite orientation.

The ability to quickly and accurately align the centerline axis of antenna with a satellite is somewhat dependent upon the type of mounting arrangement employed to support the antenna. Prior antenna mounting arrangements typically comprise a mounting bracket that is directly affixed to the rear surface of the reflector. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation.

One method that has been employed in the past for indicating when the antenna has been positioned at a proper azimuth orientation is the use of a compass that is manually supported by the installer under the antenna's support arm. When using this approach however, the installer often has difficulty elevating the reflector to the proper elevation so that the antenna will be properly aligned and then retaining the antenna in that position while the appropriate bolts and screws have been tightened. The device disclosed in U.S. Pat. No. 5,977,922 purports to solve that problem by affixing a device to the support arm that includes a compass and an inclinometer. In this device, the support arm can move slightly relative to the reflector and any such movement or misalignment can contribute to pointing error. Furthermore, devices that are affixed to the support arm are not as easily visible to the installer during the pointing process. In addition, there are many different types and shapes of support arms which can require several different adapters to be available to the installer. It will also be understood that the use of intermediate adapters could contribute pointing error if they do not interface properly with the support arm.

Another method that has been used in the past to align the antenna with a satellite involves the use of a "set top" box that is placed on or adjacent to the television to which the antenna is attached. A cable is connected between the set top box and the antenna. The installer initially points the antenna in the general direction of the satellite, then fine-tunes the alignment by using a signal strength and quality meter displayed on the television screen by the set top box. The antenna is adjusted until the onscreen meter indicates that signal strength and quality have been maximized. In addition to the onscreen display meter, many set top boxes emit a repeating tone. As the quality of the signal improves, the frequency of the tones increases. Because the antenna is located outside of the building in which the television is located, such installation method typically requires two individuals to properly align the antenna. One installer positions the antenna while the other installer monitors the onscreen meter and the emitted tones. One individual can also employ this method, but that person typically must make multiple trips between the antenna and the television until the antenna is properly positioned. Thus, such alignment methods are costly and time consuming.

In an effort to improve upon this shortcoming, some satellite antennas have been provided with a light emitting diode ("LED") that operates from feedback signals fed to the antenna by the set top box through the link cable. The LED flashes to inform the installer that the antenna has been properly positioned. It has been noted, however, that the user is often unable to discern small changes in the flash rate of the LED as antenna is positioned. Thus, such approach may result in antenna being positioned in a orientation that results in less than optimum signal quality. Also, this approach only works when the antenna is relative close to its correct position. It cannot be effectively used to initially position the antenna. U.S. Pat. No. 5,903,237 discloses a microprocessor-operated antenna pointing aid that purports to solve the problems associated with using an LED indicator to properly orient the antenna.

Such prior antenna mounting devices and methods do not offer a relatively high amount of alignment precision. Furthermore, they typically require two or more installers to complete the installation and alignment procedures. As additional satellites are sent into space, the precision at which an antenna is aligned with a particular satellite becomes more important to ensure that the antenna is receiving the proper satellite signal and that the quality of that signal has been optimized. It is also desirable to have an antenna alignment device that can be effectively used by one installer.

There is a further need for an antenna alignment equipped with a device for providing an indication of the antenna's elevation, azimuth and skew orientations.

There is yet another need for an antenna with a device that can be used in connection with a conventional set top box by an individual installer to optimize the satellite-transmitted signal received by the antenna.

There is still another need for antenna that can be quickly and efficiently aligned with a satellite by one installer.

SUMMARY OF THE INVENTION

In accordance with one embodiment of the present invention, there is provided an antenna reflector that has a front surface and a rear surface. An alignment housing is integrally attached to the rear surface of the reflector. The alignment housing supports a compass. In one embodiment, the alignment housing is glued to the rear surface of the reflector. In another embodiment, the alignment housing is molded with the rear surface. The alignment housing may have a cover plate that is removably attached thereto. The alignment housing may be watertight.

Another embodiment of the present invention comprises an antenna reflector that has a front surface and a rear surface. An alignment housing is integrally attached to the rear surface of the reflector. The alignment housing supports a compass and a level. In one embodiment, the alignment housing is glued to the rear surface of the reflector. In another embodiment, the alignment housing is molded with the rear surface. The alignment housing may have a cover plate that is removably attached thereto. The alignment housing may be watertight.

Yet another embodiment of the present invention comprises an antenna reflector that has a front surface and a rear surface. An alignment housing is integrally attached to the rear surface of the reflector. The alignment housing supports a compass and first and second levels. In one embodiment, the alignment housing is glued to the rear surface of the reflector. In another embodiment, the alignment housing is molded with the rear surface. The alignment housing may have a cover plate that is removably attached thereto. The alignment housing may be watertight.

The present invention may also comprise an antenna that has an alignment housing integrally molded thereto and may support any one or a combination of a compass and first and second levels.

It is a feature of the present invention to provide apparatuses that comprises a portion of the antenna reflector for quickly and accurately displaying readings that are indicative to the antenna's azimuth, elevation and/or skew positions.

Accordingly, the present invention provides solutions to the shortcomings of prior apparatuses and methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
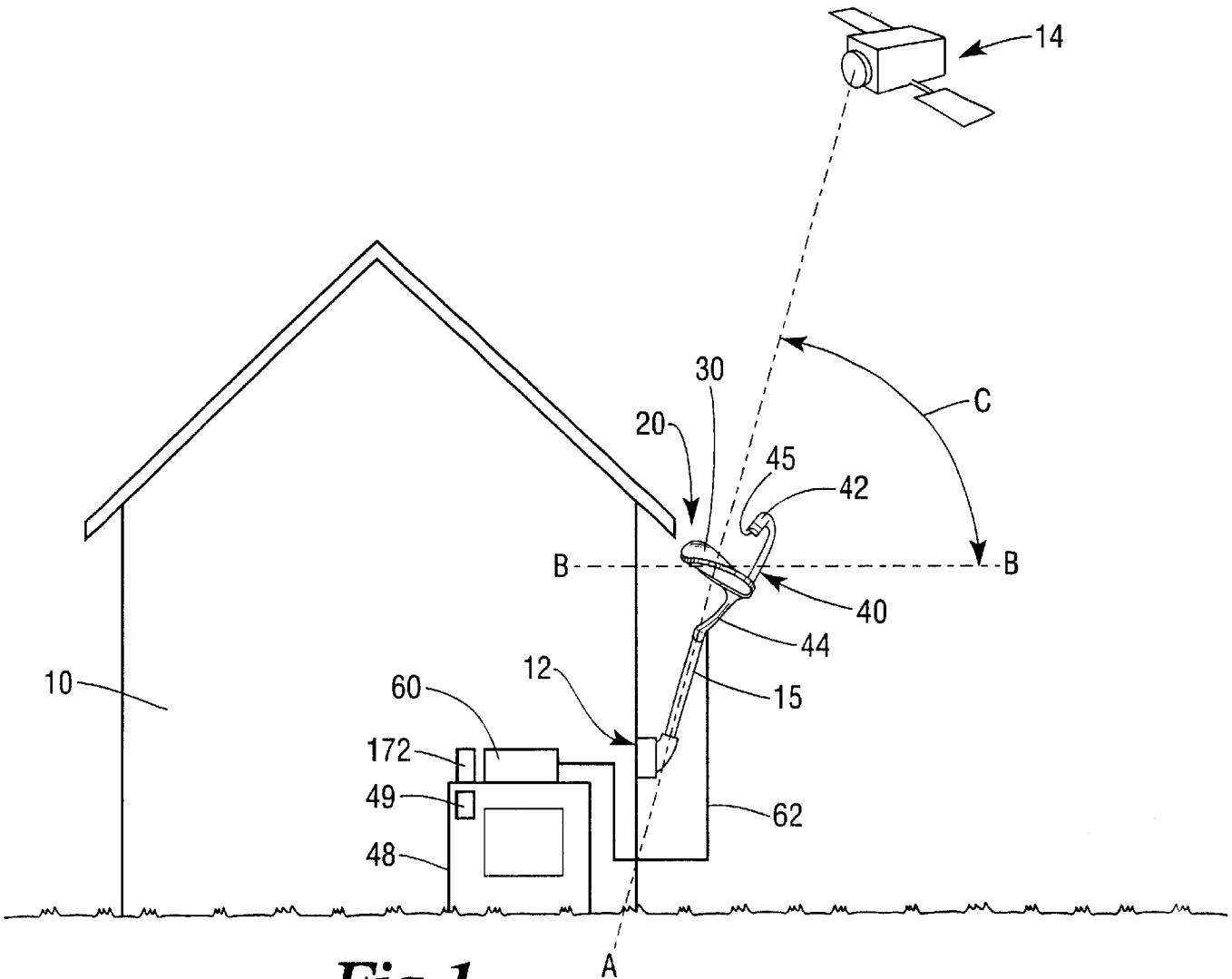
FIG. 1 is a graphical representation of an antenna attached to a building and aligned to receive a signal from a satellite.
Figure 3:
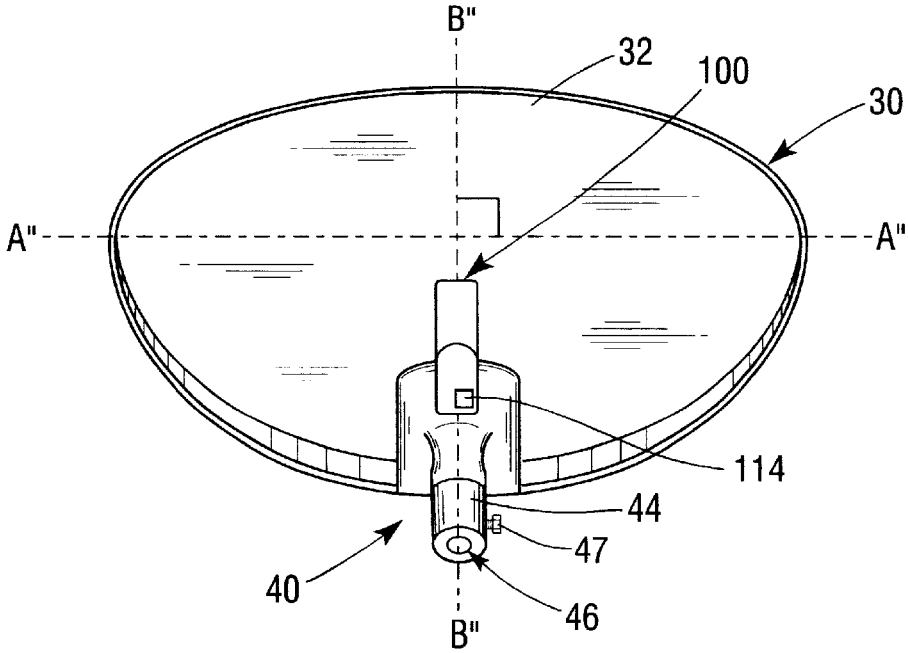
FIG. 3 is a rear view of the antenna depicted in FIG. 2.

Referring now to the drawings for the purposes of illustrating embodiments of the invention only and not for the purposes of limiting the same, FIG. 1 illustrates an antenna 20 that is attached to the wall of a residence or other building 10 by a mounting bracket 12. The antenna 20 is oriented to receive audio, video, and data signals from a satellite 14 in geosynchronous orbit around the earth. The antenna 20 includes parabolic reflector 30 and an arm assembly 40 that includes a forwardly extending portion 42 that supports a feed/LNBF assembly 45 for collecting focused signals from the reflector 30. Such feed/LNBF assemblies are known in the art and, therefore, the manufacture and operation of feed/LNBF assembly 45 will not be discussed herein. The antenna 20 has a centerline generally designated as A—A and is connected to a mounting bracket 12 by means of a rearwardly extending portion 44 of the support arm 44. A socket 46 is provided in the rearwardly extending portion 44 for receiving an antenna mounting mast 15 therein. See FIG. 3. The mounting mast 15 is affixed to a mounting bracket 12 that is attached to a wall of the building 10. As can be seen in FIG. 1, in this antenna embodiment, the centerline axis A—A is coaxially aligned with the centerline of the mounting mast 15. Such arrangement permits the antenna 20 to be easily adjusted for satellite skew by rotating the antenna about the mast 15 until the desired skew orientation is achieved.

The antenna 20 is attached to a satellite broadcast receiver ("set top box") 60 by coaxial cable 62. The set top box 60 is attached to a television monitor 48. Such set top boxes are known in the art and comprise an integrated receiver decoder for decoding the received broadcast signals from the antenna 20. During operation, the feed/LNBF assembly 45 converts the focused signals from the satellite 14 to an electrical current that is amplified and down converted in frequency. The amplified and down-converted signals are then conveyed via cable 62 to the set top box 60. The set top box 60 tunes the output signal to a carrier signal within a predetermined frequency range. A tuner/demodulator within the set top box 60 decodes the signal carrier into a digital data stream selected signal. Also a video/audio decoder is provided within the set top box 60 to decode the encrypted video signal. A conventional user interface on the television screen is employed to assist the installer of the antenna 20 during the final alignment and "pointing" of the antenna 20.

Figure 1A:
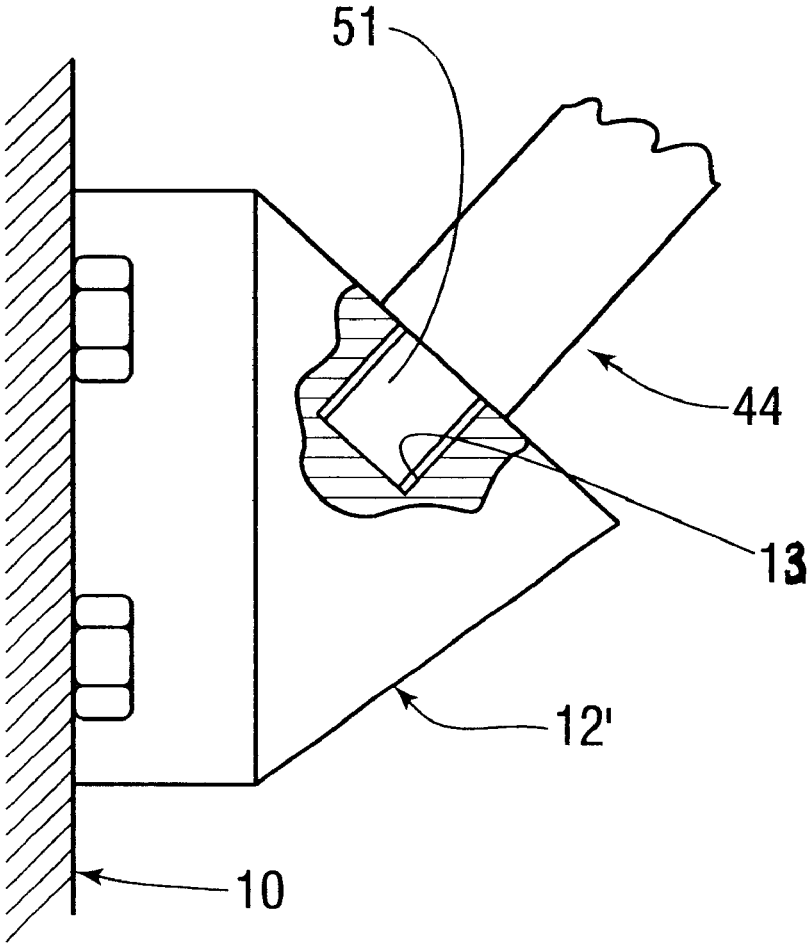
FIG. 1A is a partial view of an alternate antenna mounting member employed to support the support arm of an antenna.

In this embodiment, the mounting bracket 12 is attached to the wall of the building 10 or is affixed to a freestanding mast (not shown). The mounting bracket 12 has a mast 15 protruding therefrom that is sized to be received in a socket 46 in the mounting portion of the arm. As indicated above, the mounting bracket 12 may comprise the apparatus disclosed in co-pending U.S. patent application Ser. No. 09/751,460, entitled "Mounting Bracket", the disclosure of which is herein incorporated by reference. In another alternative mounting arrangement, the rearwardly extending portion of the support arm 44 may have a protrusion 51 formed thereon or attached thereto that is sized to be received and retained within a mounting bracket 12' that has a socket 13' formed therein. See FIG. 1A. As the present Detailed Description proceeds, those of ordinary skill in the art will readily appreciate that the various embodiments of the antenna pointing devices of the present invention may be used with a variety of other antennas that are supported by various other types of mounting brackets without departing from the spirit and scope of the present invention. Thus, the various embodiments of the present invention should not be limited to use in connection with the specific antenna arrangements and mounting fixtures disclosed herein.

Figure 2:
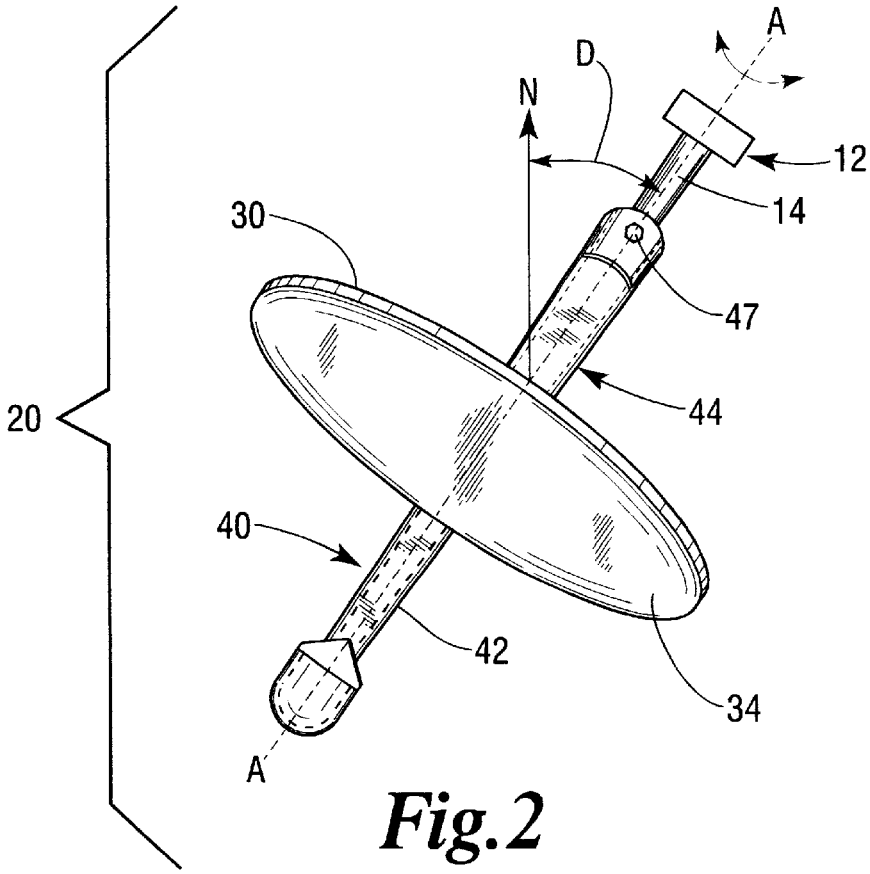
FIG. 2 is a plan view of an antenna attached to a mounting bracket.

Antenna 20 must be properly positioned to receive the television signals transmitted by the satellite 14 to provide optimal image and audible responses. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIGS. 1 and 2, the elevation is adjusted by virtue of an elevation adjustment mechanism on the mounting bracket 12. In one mounting bracket embodiment disclosed in the above-mentioned patent application, the elevation is adjusted by loosening two elevation locking bolts and turning an elevation adjustment screw until the desired elevation has been achieved. The elevation locking bolts are then tightened to lock the bracket in position. As shown in FIG. 2, "azimuth" refers to the angle of axis A—A relative to the direction of true north in a horizontal plane. That angle is generally designated as angle "D" in FIG. 2. "Skew" refers to the angle of rotation of the reflector about the centerline axis A—A.

In this embodiment, the reflector 30 is molded from fiberglass reinforced plastic utilizing conventional molding techniques. However, reflector 30 may be fabricated from a variety of other suitable materials such as, for example, stamped steel or aluminum. The reflector 30 depicted in FIGS. 2 and 3 has a rear portion or surface 32 and a front surface 34. The support arm assembly is affixed to the lower perimeter of the reflector 30 by appropriate fasteners such as screws or like (not shown).

The reflector 30 of the present invention also has an alignment device 100 integrally mounted thereto. As used herein, the term "integral" means not readily removable from the antenna reflector without the use of tools. In the embodiment depicted in FIGS. 4–6, the alignment device 100 includes a housing 110 that is molded with the reflector 30 and protrudes from the rear surface 32. However, the housing 110 could otherwise be permanently affixed to the rear surface of the antenna reflector, by other suitable fastener mediums such as adhesive, screws, rivets, etc. The housing 110 illustrated in FIGS. 4 and 6 is molded with the rear surface 32 of the reflector and protrudes therefrom to define a cavity 112 for supporting one or more of the following components therein: a conventional digital compass 120, a first digital compass 130, and a second digital compass 142.

Compass 120 has a digital display 122 and serves to comprise an azimuth meter. See FIG. 6. Digital compasses are known in the art and, therefore, the manufacture and operation thereof will not be discussed in great detail herein. For example, the conventional digital compasses of the type commonly employed in the surveying industry, such as those manufactured by Bosch could be successfully employed. As will be discussed in further detail below, the azimuth display 122 displays the azimuth setting for the centerline axis A—A of the reflector 30.

Figure 4:
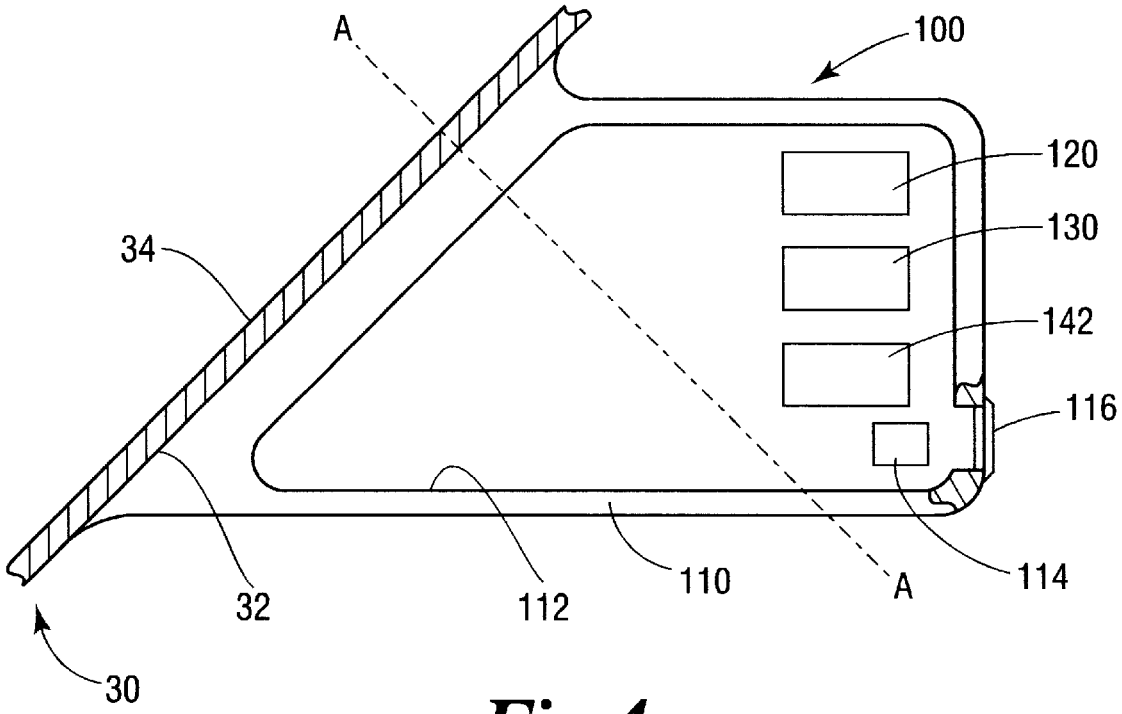
FIG. 4 is a partial cross-sectional view of an antenna reflector illustrating an integral alignment housing protruding from the rear surface of the reflector with the cover plate removed from the housing to reveal the interior thereof.
Figure 5:
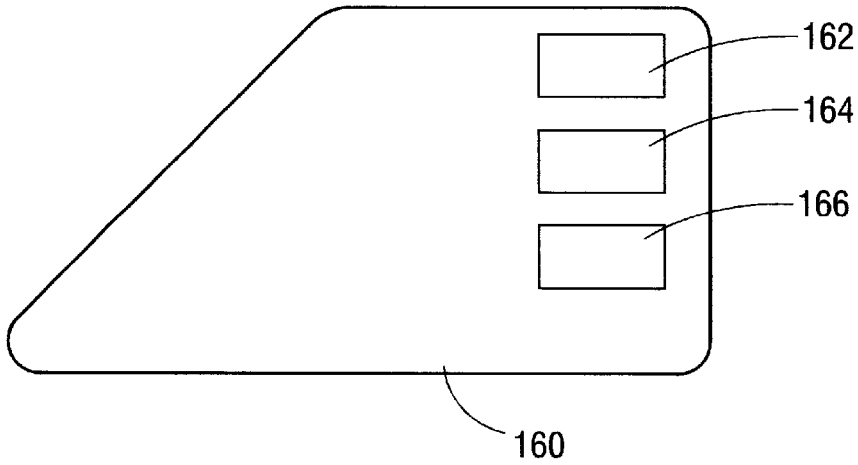
FIG. 5 is a front view of a cover plate for the alignment housing shown in FIG. 4.
Figure 6:
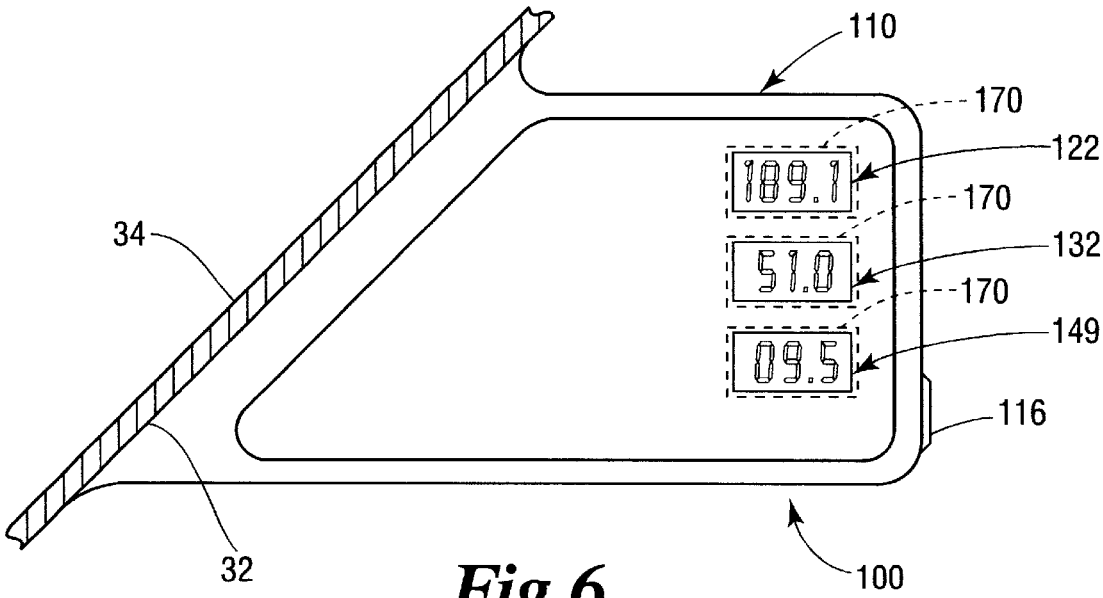
FIG. 6 is a partial view of the reflector of FIG. 4 with the cover plate of FIG. 5 attached to the alignment housing.

Also in the embodiment depicted in FIGS. 4 and 6, a first digital level 130 that has a digital level display 132 is supported in the housing 110. Such digital levels are known in the art and, therefore, their construction and operation will not be discussed in great detail herein. For example, the digital levels commonly employed in the surveying industry, such as those manufactured by Bosch may be successfully employed. However, other digital levels may be used. Referring back to FIG. 3, the reflector 30 has a major axis A"—A" that extends along the reflector's longest dimension. Major axis A"—A" is perpendicular to the centerline A—A. Similarly, the reflector 30 has a minor axis B"—B" that is perpendicular to major axis A"—A" and is also perpendicular to the centerline A—A. In this embodiment, the centerline of the first digital level 130 is oriented such that it is received in a plane defined by the centerline A—A and the minor axis B"—B".

Figure 5A:
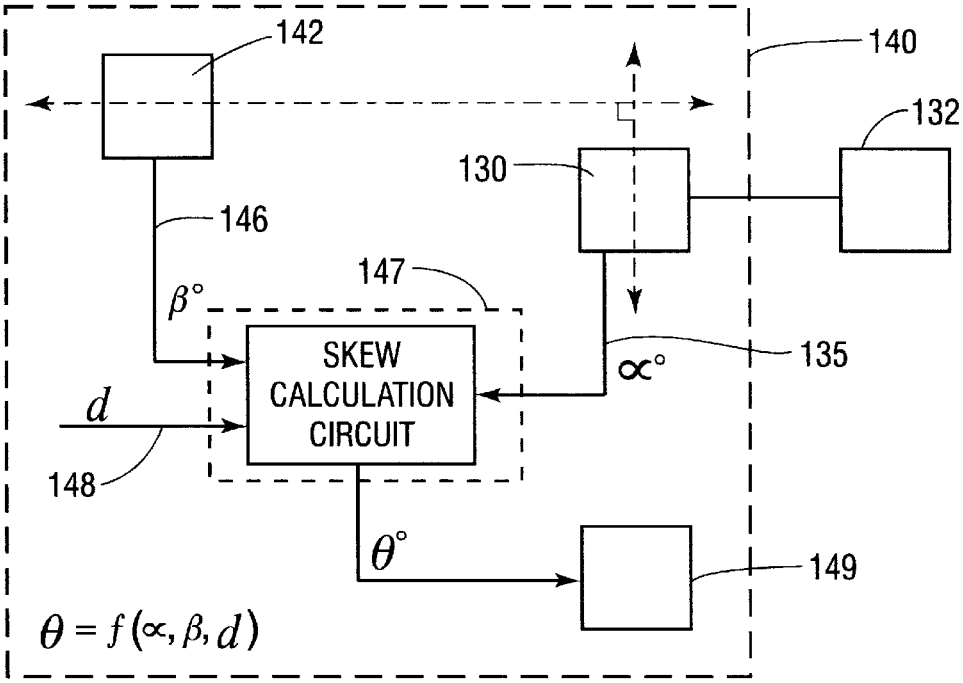
FIG. 5A is a schematic drawing of one control circuit arrangement that may be employed by one or more embodiments of the present invention to calculate the skew of the antenna.

This embodiment of the present invention also includes a skew meter generally designated as 140. The skew meter 140 includes a second digital level 142 of the type described above that is mounted perpendicular to the first digital level 130 (i.e., the centerline of the second digital level 142 is within the plane defined by the centerline axis A—A and the major axis A"—A"). As can be seen in FIG. 5A, the output of the first digital level 130, which is designated as 135 (defining angle $\alpha$) and the output of the second digital level 142, which is designated as 146 (defining angle $\beta$), are sent to a conventional microprocessor 147. A calibration input, generally designated as 148 and defining distance "d" between a reference point on the device 100 and the centerline A—A of the reflector 30 is also sent to the microprocessor 147. This calibration can be made at the factory to eliminate the need for the installer to perform the calibration step. Utilizing standard trigonometry calculations, the microprocessor 147 calculates the skew angle $\theta$ of the reflector 30 and displays it on a digital skew meter display 149. In this embodiment, the digital compass 120 and the first and second digital levels 130 and 142, respectively are powered by a battery 114 supported in the housing 110. The housing 110 is provided with a battery access door 116 to permit the installation and replacement of battery 114. In the alternative, the above-mentioned electrical powered components could be powered by a conventional solar battery arrangement.

In this embodiment, the compass 120, and first and second levels (130, 142) are retained within the housing 110 by a cover plate 160 that has an azimuth meter opening 162 for permitting the display 122 of digital compass 120 to be viewed therethrough. Likewise, the cover plate 160 has an elevation meter opening 164 for permitting the display 132 of the first digital level 130 to be viewed from the exterior of the housing 110. In addition, the cover plate 160 has yet another opening 166 for permitting the skew meter display 149 to be viewed therethrough. To prevent water and moisture which could hamper or destroy the above-mentioned components from entering the housing 110, the cover plate 160 is attached to the housing 110 by a waterproof or other suitable adhesive. If desired, a permanent adhesive could be employed to attach the cover plate 160 to the housing 110. However, such construction would prevent subsequent maintenance or replacement of a malfunctioning component within the housing 110. Other types of adhesives, such as silicon caulking and the like could be employed to achieve a waterproof seal between the housing 110 and the cover plate 160, yet permit removal of the cover plate 160 by cutting through the caulking. The embodiment depicted in FIGS. 7–9, which will be discussed in further detail below, employs a removable cover plate 360 that snaps or is otherwise removably attached to the housing 310 and employs a conventional O-ring seal or gasket to achieve a waterproof seal between the housing 310 and the cover plate 360. In addition, conventional rubber or polymeric seals, generally designated as 380, or silicone caulking or other waterproof sealant etc. may be employed to establish a waterproof seal between the cover plate and the azimuth meter, elevation meter, and the skew meter.

Figure 6A:
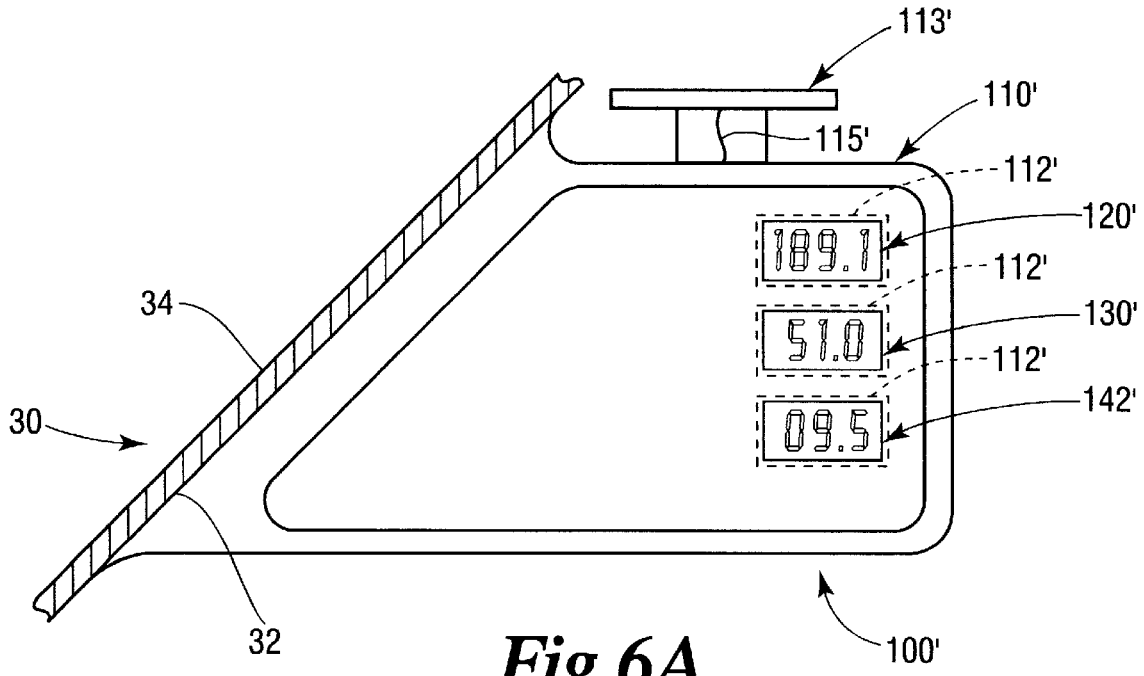
FIG. 6A is a partial view of another antenna embodiment of the present invention.
Figure 6B:
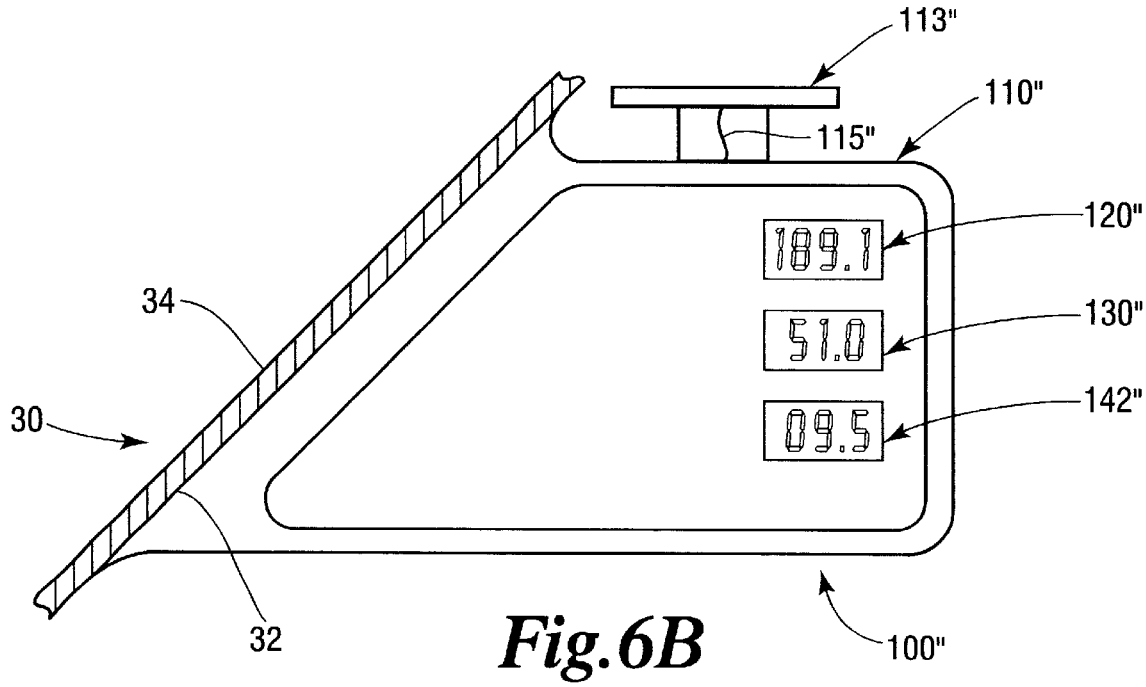
FIG. 6B is a partial view of another antenna embodiment of the present invention.

In an alternative embodiment depicted in FIG. 6A, the device 100' comprises a housing 110' that comprises a solid piece of plastic or other material that is either integrally molded to the rear surface 32 of the reflector 30 or otherwise attached thereto with appropriate fasteners, such as adhesive, screws, welding etc. The digital compass 120' and the first digital level 130' and the second digital level 142' are each molded into a hermetically sealed plug. Each plug is inserted into a corresponding hole 112' in housing 110' and may be retained therein by a frictional fit. Those components could then be powered by a solar battery 113' that is attached to the housing 110' or other portion of the antenna 20. The device 100' would otherwise operate in the same manner as device 100. In yet another embodiment as depicted in FIG. 6B, the alignment device 100" includes a digital compass 120", the first digital level 130" and the second digital level 142" are molded into a mounting block 110" such that those components are hermetically sealed therein. A solar battery 113" communicates with a power lead 115" that protrudes from the mounting block 110". The reader will appreciate that although the solar battery 113" is shown mounted behind the reflector 30, it can be mounted anywhere adjacent the reflector 30 and connected to the components described above, via a cable (not shown). The mounting block 110" is affixed to the rear surface 32 of the reflector 30 by adhesive, screws, etc. such that the components are arranged in the above-described manner with respect to the reflector's centerline and the planes defined by the intersection of the centerline and the major and minor axes.

The antenna alignment device 100 may be employed to align the antenna's centerline axis A—A with the satellite as follows. After the antenna-mounting bracket 12 has been installed, the antenna 20 is affixed to the mounting bracket 12. In this embodiment, the mast portion 15 of the mounting bracket 12 is inserted into the socket 46 in the rear-mounting portion 44 of the arm assembly 40. The mast 15 is retained within the socket 46 by means of one or more setscrews 47 that extend through the rear-mounting portion 44 to engage the mast 14. See FIGS. 2 and 3.

During installation of the antenna 20, the azimuth meter 140 will display the azimuth reading for the antenna's initial position. The installer then adjusts the antenna's position until the azimuth meter 122 displays the desired azimuth reading. The antenna 20 is then locked in that position. The installer then observes the elevation reading displayed by the elevation meter 132 and adjusts the position of the antenna 20 until the elevation meter 132 displays the desired reading and the antenna 20 is locked in that position. The setscrews 47 are loosened to permit the antenna 20 to be rotated about the mast 15. The user then observes the skew meter display 149 and rotates the rearwardly extending portion 44 of the support arm 40 about the mast 15 until the skew meter display 149 displays the desired setting. Thereafter, the setscrews 47 are screwed into contact the support mast 15 to retain the antenna 20 in that position. The skilled artisan will appreciate that, because the centerline axis A—A is coaxially aligned with the centerline of the socket 46 in the support arm 40, the antenna 20 can be moved to the desired skew orientation by simply rotating the antenna reflector 30 about the mast 15. The order of antenna adjustments described herein is illustrative only. Those of ordinary skill in the art will appreciate that the installer could, for example, set the skew first or the elevation first when orienting the antenna 20.

If the installer wishes to employ a set top box 60 to further optimize the antenna's alignment with the satellite 14, a coaxial cable 62 is attached to the feed/LNBF assembly 45 and the set top box 60. The antenna's position is further adjusted while monitoring the graphical display on the television 48 and the audio signal emitted by the set top box.

Figure 7:
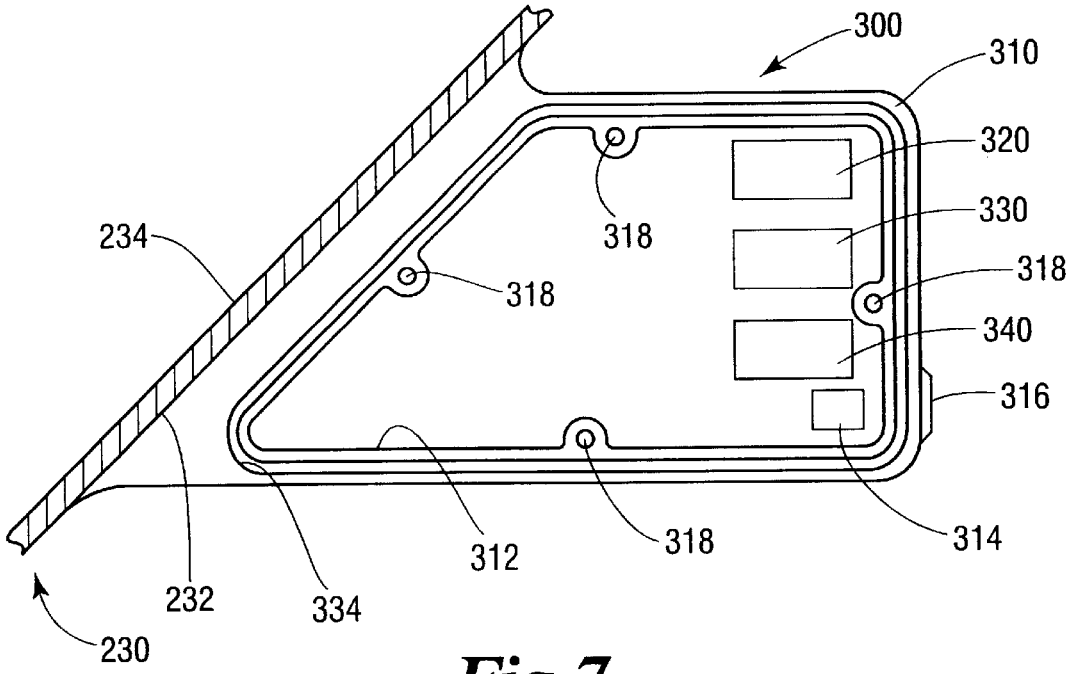
FIG. 7 is a partial cross-sectional view of another antenna reflector illustrating another integral alignment housing protruding from the rear surface of the reflector with the housing plate removed from the housing to reveal the interior thereof.
Figure 8:
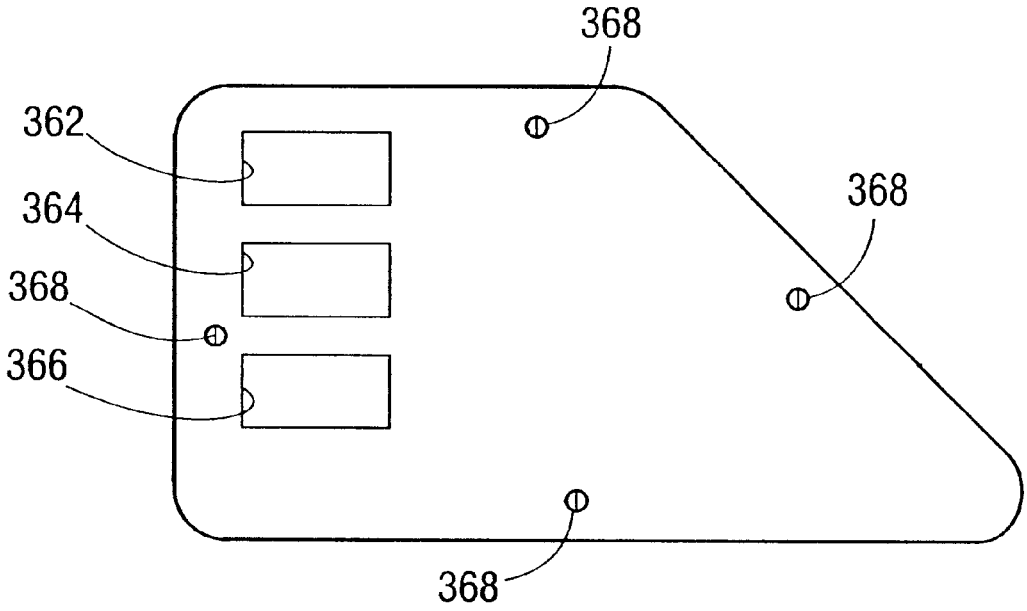
FIG. 8 is a rear view of a cover plate for the alignment housing depicted in FIG. 7.
Figure 9:
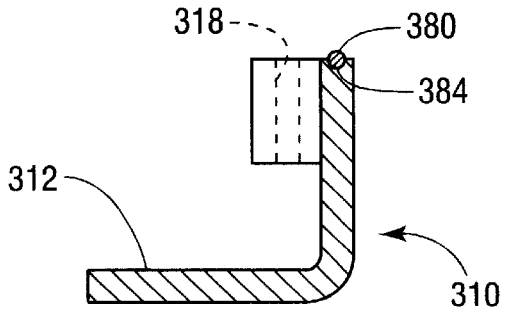
FIG. 9 is a partial cross-sectional view of the alignment housing of FIG. 7 illustrating an O-ring seated in the seal groove formed in the alignment housing.

Another embodiment of the present invention is depicted in FIGS. 7–9. In this embodiment, except for the differences discussed below, reflector 230 is identical in construction as reflector 30 described above. Thus reflector 230 has a front surface 234, a rear surface 232. In addition, an antenna alignment device 300 is integrally attached to the rear surface 232 of the reflector 230. Antenna alignment device 300 includes a housing 310 that defines a cavity 312 for supporting a compass 320, a first digital level 330, a second digital level 340 and a battery 314 in the manner described above. Housing 310 also has a removable access door 316 for replacing the battery 314.

A cover plate 360 for this embodiment is depicted in FIG. 8. An azimuth meter opening 362 for permitting the display of digital compass 320 to be viewed therethrough is provided in the cover plate 360. Likewise, the cover plate 360 has an elevation meter opening 364 for permitting the display 332 of the first digital level 330 to be viewed from the exterior of the housing 310. In addition, the cover plate 360 has yet another opening 366 for permitting the display 342 of the second digital level 340 to be viewed therethrough To facilitate removable attachment of the cover plate 360 to the housing 310, a plurality of sockets 318 may be provided in the housing 310 as shown in FIG. 7. As shown in FIG. 8, cover plate 360 has a plurality of lugs 368 protruding therefrom that are sized to snap into the sockets 318. Thus, cover plate 360 may be snapped onto the housing 310 by inserting the lugs 368 into the corresponding sockets. Those of ordinary skill in the art will appreciate, however, that other means for removably fastening the cover plate 360 to the housing 310 such as, for example, screws, clamps, etc. may be successfully used.

To achieve a seal between the cover plate 360 and the housing 310, a conventional O-ring 380 or seal may be provided between the cover plate 360 and housing 310. In the embodiment depicted in FIG. 7, a groove 384 is provided around the perimeter in the cavity 312 to receive a portion of the O-ring 380 seal therein. See FIG. 9.

Figure 10:
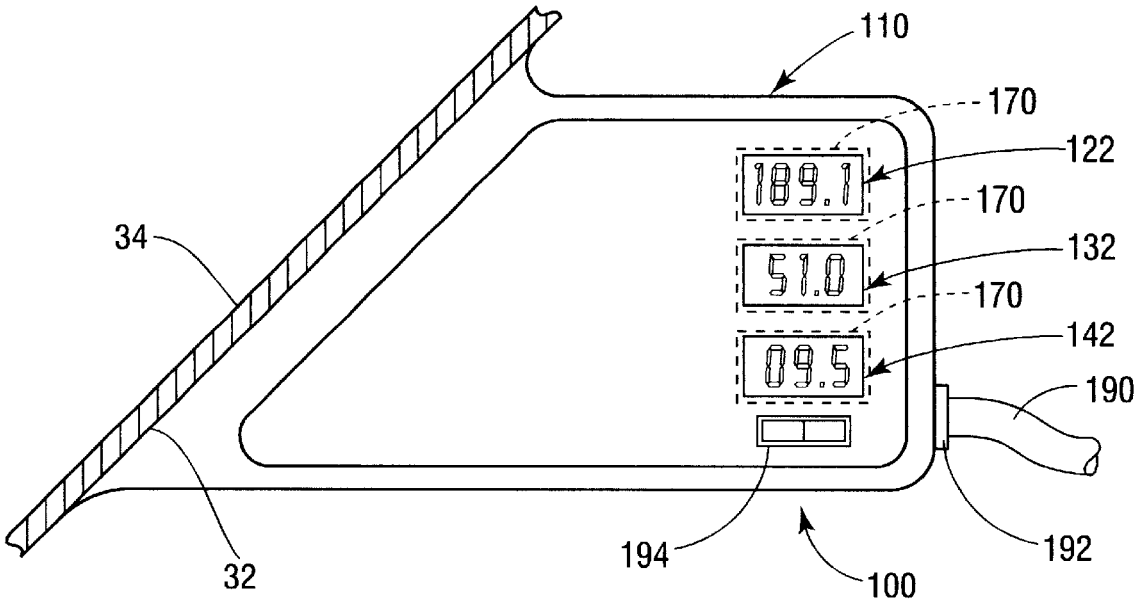
FIG. 10 is a partial cross-sectional view of an antenna reflector illustrating an integral alignment housing protruding from the rear surface of the reflector and housing alignment components that are powered with alternating current.

The embodiments described above employ components that are battery powered. Those of ordinary skill in the art will appreciate that such components may be powered by alternating current. For example, in the embodiment depicted in FIG. 10, alternating current is supplied to the components housed within housing 110 by cable 190 that extends through the lower end of the housing 110. A conventional seal member 192 may be employed to achieve a waterproof seal between the cable 190 and the housing 110. If desired, a conventional switch 194 may be employed to turn off the components when not in use.

Figure 11:
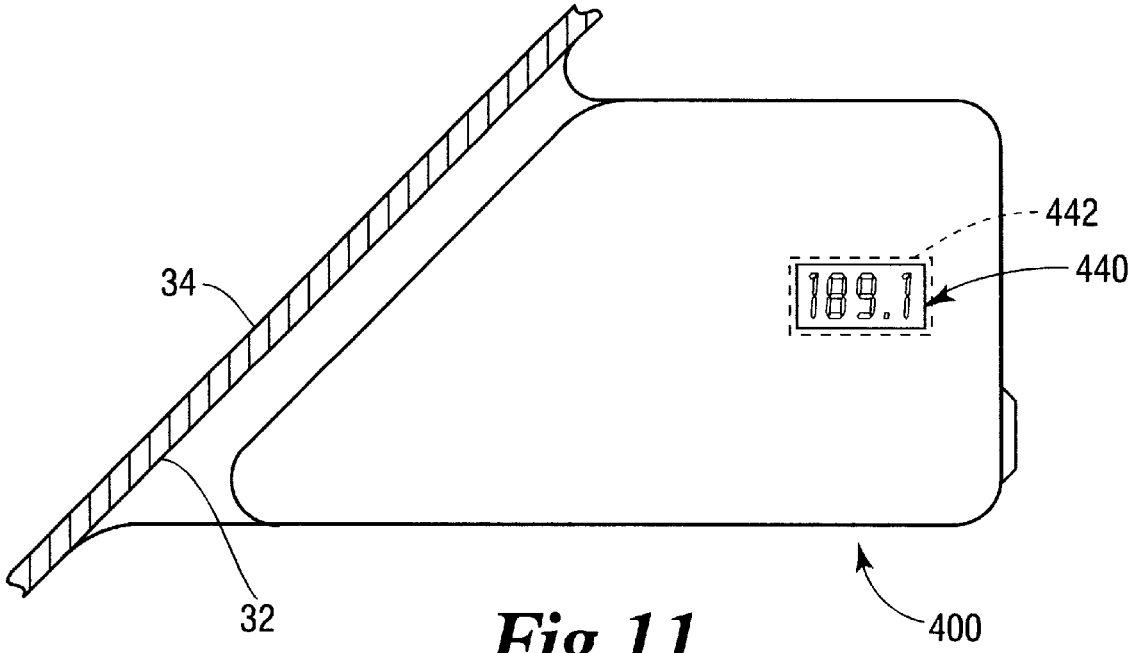
FIG. 11 is a partial cross-sectional view of an antenna reflector with another antenna alignment apparatus integrally attached to the rear surface thereof.
Figure 12:
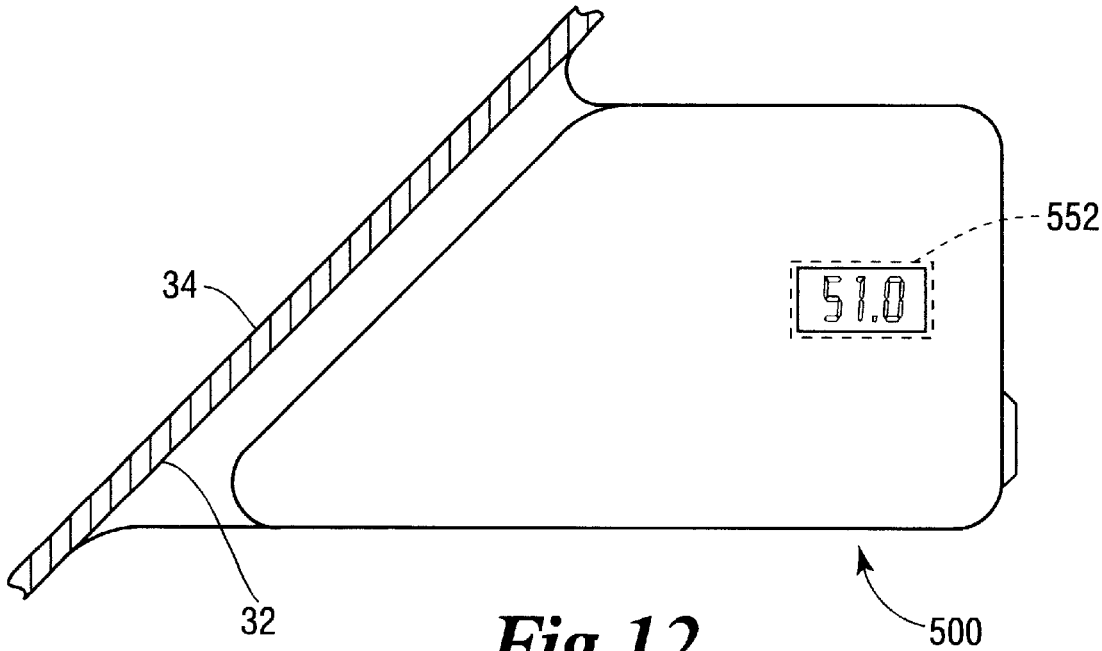
FIG. 12 is a partial cross-sectional view of an antenna reflector with another antenna alignment apparatus integrally attached to the rear surface thereof.
Figure 13:
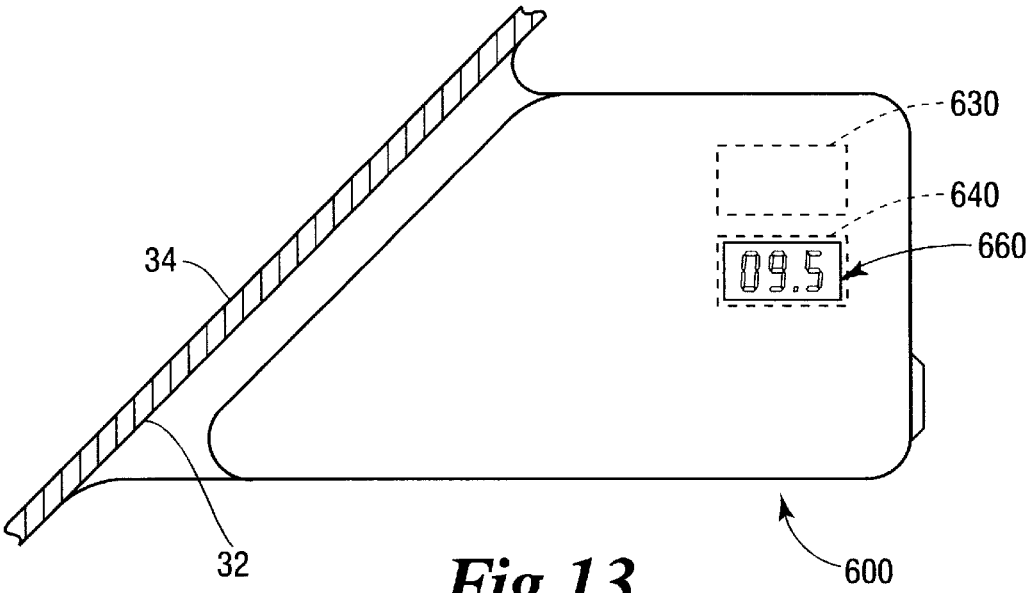
FIG. 13 is a partial cross-sectional view of an antenna reflector with another antenna alignment apparatus integrally attached to the rear surface thereof.

The antenna alignment apparatuses of the present invention may comprise one or more of the following components: (i) digital compass, (ii) a first digital level, and/or (iii) a second digital level. For example, as shown in FIG. 11, the antenna pointing device 400 is substantially identical to the antenna pointing devices described above, except that device 400 only includes a digital compass 440 that has a digital display 442. Those of ordinary skill in the art will appreciate that an analog compass (not shown) could also be employed. However, the device 400 will only provide an azimuth reading for the antenna 20. Similarly, as shown in FIG. 12, the antenna alignment device 500 is substantially identical to the antenna pointing devices 100 described above, except that the device 500 only includes a digital level 552. The centerline of the digital level 552 lies in a plane defined by the minor axis "B" and the centerline A—A of the reflector 30. It will be further understood that an analog level could also be employed. However, the alignment device 500 will only provide an elevation reading for the antenna 20. The antenna alignment device 600 as shown in FIG. 13 has a skew meter 660 that displays a skew setting that is generated by two digital levels (630, 640) and a microprocessor 642 arranged in the manner described above to emit a display that is indicative of the skew of the antenna 20. The alignment device 600 only provides a skew reading for the antenna 20. The reader will appreciate that the embodiments depicted in FIGS. 11–13, may be battery powered (including solar powered battery assemblies) or be powered by alternating current in the manner described above.

Figure 14:
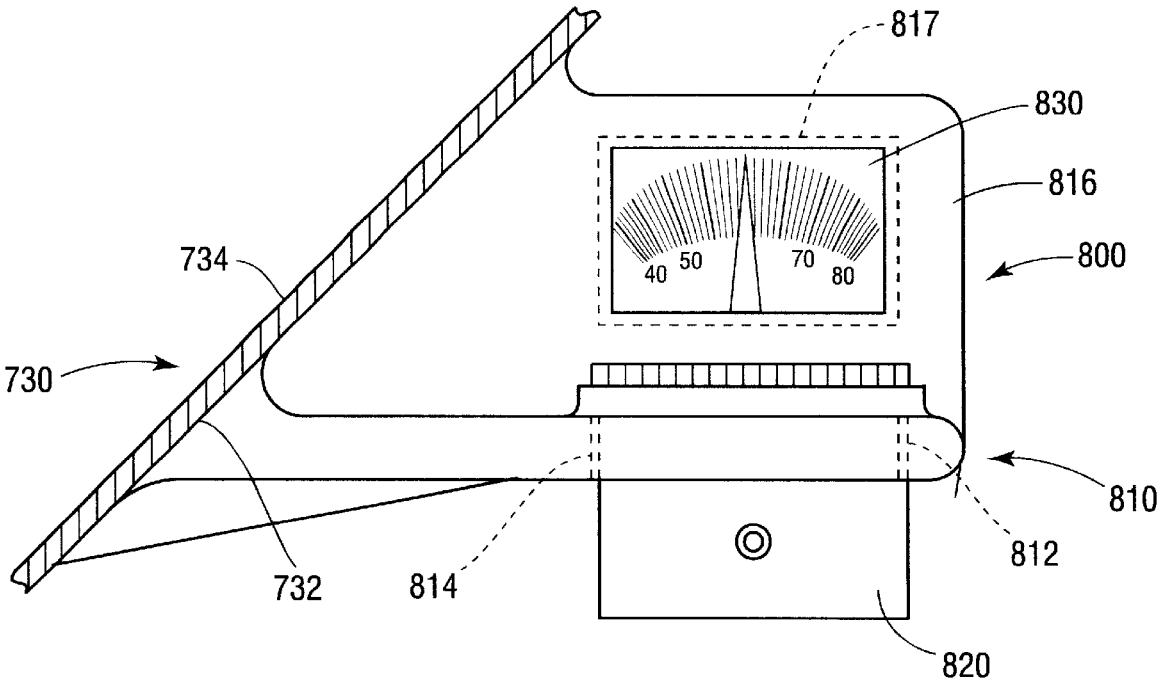
FIG. 14 is a partial cross-sectional view of an antenna reflector with another antenna alignment apparatus integrally attached to the rear surface thereof.
Figure 15:
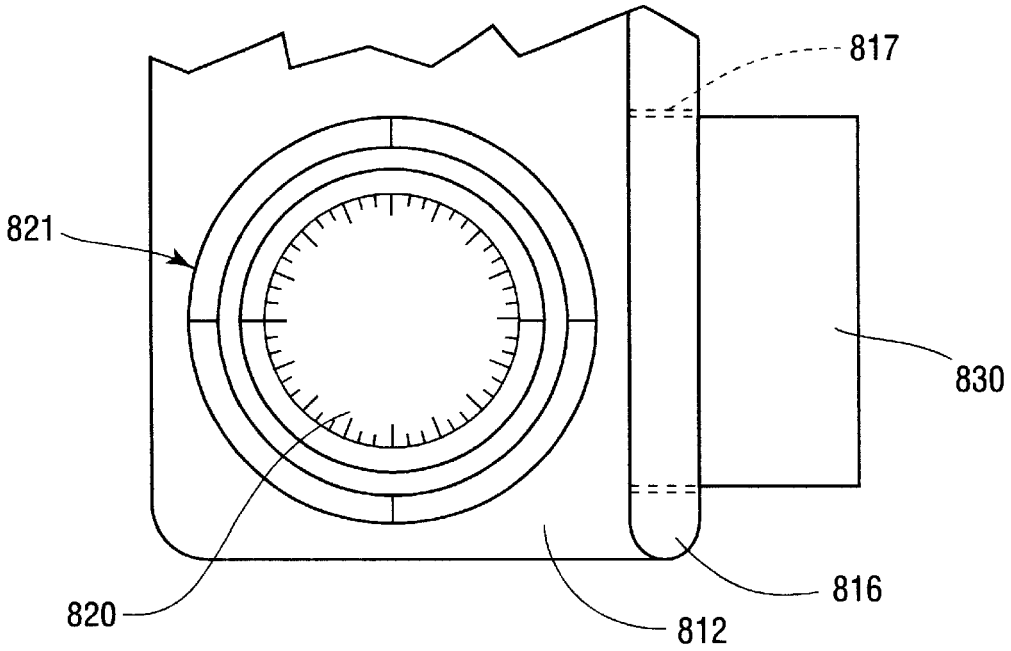
FIG. 15 is a partial top view of the antenna alignment apparatus of FIG. 14.
Figure 16:
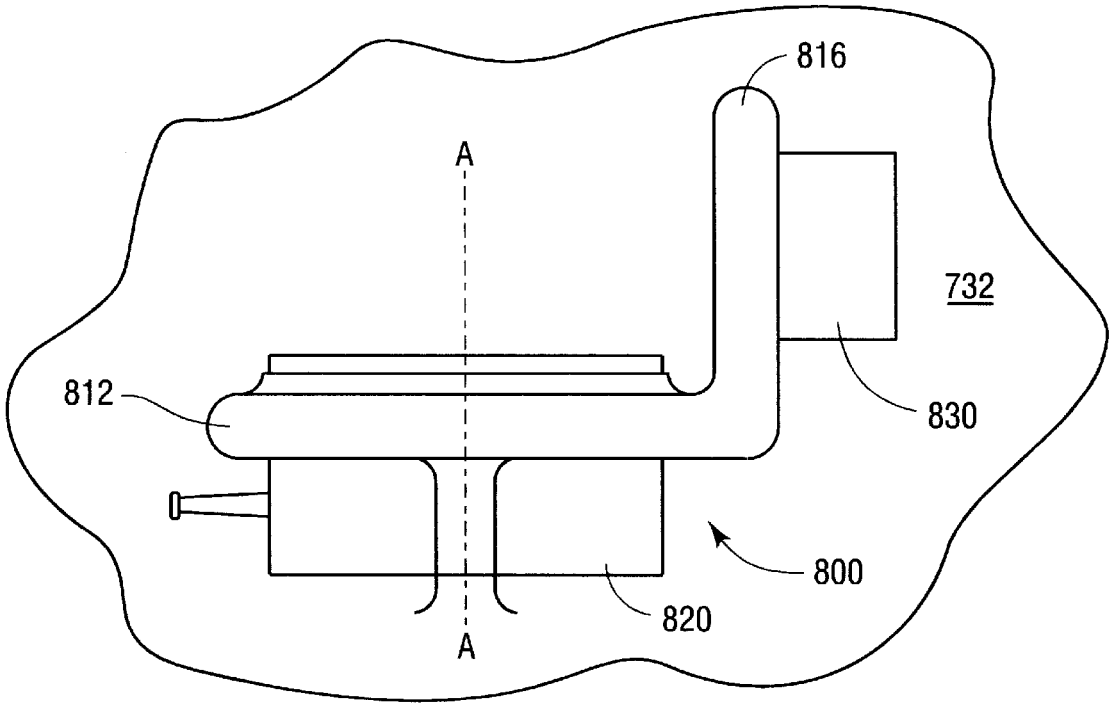
FIG. 16 is a partial rear view of the antenna reflector and antenna alignment apparatus of FIGS. 14 and 15.

Another embodiment of the present invention is depicted in FIGS. 14–16. In this embodiment, the antenna reflector 730 is identical to the antenna reflector 30 as described above, except for the differences discussed below. As can be seen in FIG. 14, the reflector 730 has a front surface 734, a rear surface 732. An antenna alignment device, generally designated as 800 protrudes from the rear surface 732. More specifically, a support assembly 810 is integrally formed with the rear surface 732 or is otherwise attached thereto by appropriate fastener means such as adhesive, welding, screws, etc. Support assembly 810 includes a horizontal support member 812 that supports a conventional analog compass 820 therein. Compass 820 may comprise any commercially available analog compass such as the analog compasses commonly employed in the surveying industry. For example, those analog compasses manufactured by Bosch could be employed. As can be seen in FIGS. 15 and 16, the centerline A—A is aligned with the center of the compass 820. Compass 820 is mounted in a conventional gimball assembly 821 that is retained in the hole 814 in the support member 812 by a frictional fit.

The support assembly 810 also includes a vertical support member 816 that supports an analog level 830 therein. Level 830 may comprise any suitable analog level such as the analog levels employed in the surveying industry. Those conventional analog levels manufactured by Bosch could be employed. Level 830 may be supported in a hole 817 in the vertical support member 816 such that it its centerline is in the plane formed by the minor axis B"—B" and the centerline A—A of the reflector 730. Hole 817 may be sized relative to the level 830 such that a frictional fit is established between the vertical support member 816 and the level 830. In the alternative, the level 830 may be permanently attached to the vertical support member 830 by adhesive or it may be removably supported in the hole 817 such that it can be removed therefrom after the antenna alignment process has been completed. The skilled artisan will appreciate that the compass 820 and the level 830 may be used to set the antenna's azimuth and elevation orientations in the manners described above.

Thus, from the foregoing discussion, it is apparent that the present invention solves many of the problems encountered by prior antenna alignment devices and methods. In particular, various embodiments of the present invention enable one installer to quickly and efficiently install and align an antenna with a satellite. Various embodiments of the present invention also enable the installer to use a set top box to optimize the antenna's orientation without making several trips between the antenna and the television to which the set top box is attached. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. An antenna, comprising:

an antenna reflector having a front surface and a rear surface and a centerline;

an alignment housing integrally molded with said rear surface of said antenna reflector; and a compass supported by said alignment housing for indicating a position of said centerline relative to true north in a horizontal plane.

2. The antenna of claim 1 wherein said alignment housing is glued onto a rear surface of said antenna reflector.

3. The antenna of claim 1 further comprising a cover plate permanently affixed to said alignment housing.

4. The antenna of claim 1 further comprising a cover plate removably affixed to said alignment housing.

5. The antenna of claim 4 further comprising a seal between said alignment housing and said cover plate.

6. The antenna of claim 1 wherein said alignment housing is watertight.

7. The antenna of claim 1 wherein said compass is hermetically sealed in a plug assembly that is attached to said alignment housing.

8. The antenna of claim 1 further comprising a first level supported by said alignment housing.

9. The antenna of claim 8 wherein said alignment housing is glued onto a rear surface of said antenna reflector.

10. The antenna of claim 8 further comprising a cover plate permanently affixed to said alignment housing.

11. The antenna of claim 8 further comprising a cover plate removably affixed to said alignment housing.

12. The antenna of claim 11 further comprising a seal between said alignment housing and said cover plate.

13. The antenna of claim 8 wherein said alignment housing is watertight.

14. The antenna of claim 8 wherein said first level is hermetically sealed in a plug assembly that is attached to said alignment housing.

15. The antenna of claim 8 wherein said first level comprises a first digital level.

16. The antenna of claim 8 wherein said compass comprises a digital compass and wherein said first level comprises a first digital level.

17. The antenna of claim 1 wherein said compass comprises a digital compass.

18. An antenna, comprising:

an antenna reflector having a front surface and a rear surface and a centerline;

an alignment housing integrally attached to said rear surface of said antenna reflector;

a compass supported by said alignment housing for indicating a position of said centerline relative to true north in a horizontal plane;

a first level supported by said alignment housing; and a second level supported by said alignment housing.

19. The antenna of claim 18 wherein said alignment housing is glued onto a rear surface of said antenna reflector.

20. The antenna of claim 18 further comprising a cover plate permanently affixed to said alignment housing.

21. The antenna of claim 18 further comprising a cover plate removably affixed to said alignment housing.

22. The antenna of claim 21 further comprising a seal between said alignment housing and said cover plate.

23. The antenna of claim 18 wherein said alignment housing is watertight.

24. The antenna of claim 18 wherein said second level comprises a second digital level.

25. The antenna of claim 18 wherein said compass comprises a digital compass and said first level comprises a first digital level and wherein said second level comprises a second digital level.

26. The antenna of claim 25 further comprising a microprocessor coupled to said first and second digital levels.

27. The antenna of claim 26 wherein said microprocessor is received within said housing.

28. The antenna of claim 25 wherein said digital compass and said first and second digital levels are powered by a power source in said housing.

29. The antenna of claim 28 wherein said power source is solar powered.

30. An antenna, comprising:

an antenna reflector having a front surface and a rear surface and a centerline;

an attachment block integrally molded with said rear surface of said antenna reflector and protruding therefrom;

a compass supported in a hermetically sealed compass housing, said hermetically sealed compass housing supported by said attachment block;

a level supported in a hermetically sealed level housing, said hermetically sealed level housing supported by said attachment block; and a power source coupled to said compass and said level.

31. The antenna of claim 30 wherein said power source comprises a solar battery assembly.

32. An antenna, comprising:

an antenna reflector having a front surface and a rear surface and a centerline;

an attachment block integrally molded with said rear surface of said antenna reflector and protruding therefrom;

a compass supported in a hermetically sealed compass housing, said hermetically sealed compass housing supported on said attachment block;

a first level supported in a first hermetically sealed level housing, said hermetically sealed level housing supported by said attachment block;

a second level supported in a second hermetically sealed level housing, said hermetically sealed level housing supported by said attachment block; and a power source coupled to said compass and said first and second levels.

33. The antenna of claim 32 wherein said power source comprises a solar battery.

34. An antenna, comprising:

antenna reflector having a front surface and a rear surface and a centerline;

an alignment housing integrally molded with said rear surface of said antenna reflector;

a cover plate removably affixed to said alignment housing and having a seal therebetween; and a compass supported by said alignment housing.

35. An antenna, comprising:

antenna reflector having a front surface and a rear surface and a centerline;

an alignment housing integrally molded with said rear surface of said antenna reflector;

a cover plate removably affixed to said alignment housing and having a seal therebetween;

a compass supported by said alignment housing; and a first level supported by said alignment housing.

36. An antenna, comprising:

antenna reflector having a front surface and a rear surface and a centerline;

an alignment housing integrally molded with said rear surface of said antenna reflector;

a cover plate removably affixed to said alignment housing and having a seal therebetween;

a compass supported by said alignment housing;

a first level supported by said alignment housing; and a second level supported by said alignment housing.

37. An antenna, comprising:

antenna reflector having a front surface and a rear surface and a reflector centerline axis and a major axis that extends along a longest dimension of said antenna reflector and which is perpendicular to said reflector centerline axis, said antenna reflector further having a minor axis that is perpendicular to said major axis and said reflector centerline axis;

an alignment housing attached to said rear surface of said antenna reflector;

a compass supported by said alignment housing; and a first digital level supported by said alignment housing and having a digital level centerline that is received in a plane defined by said reflector centerline axis and said minor axis of said antenna reflector.

38. An antenna, comprising:

an antenna reflector having a front surface, a rear surface, a reflector centerline axis, and a major axis, said major axis extending along a longest dimension of said antenna reflector and being perpendicular to said reflector centerline axis, said antenna reflector further having a minor axis that is perpendicular to said major axis and said reflector centerline axis;

an alignment housing integrally attached to said rear surface of said reflector;

a digital compass supported by said alignment housing;

a first digital level supported by said alignment housing and having a first digital level centerline that is received in a plane defined by said reflector centerline axis and said minor axis of said antenna reflector; and a second digital level supported by said alignment housing and having a second digital level centerline that is perpendicular to the first digital level centerline.

39. An antenna, comprising:

an antenna reflector having a rear surface;

an alignment housing integrally attached to said rear surface of said antenna reflector;

a compass supported by said alignment housing;

a first digital level supported by said alignment housing;

a second digital level supported by said alignment housing;

a microprocessor coupled to said first and second digital levels; and a digital skew meter display supported in said housing and coupled to said microprocessor.

* * * * *